US005788470A

United States Patent [19]

Okuda et al.

[11] Patent Number: 5,788,470

[45] Date of Patent: Aug. 4, 1998

[54] FLUID MACHINE HAVING TWO SPIRAL WORKING MECHANISMS WITH A STEPPED SHAPE SECTION

[75] Inventors: Masayuki Okuda; Hirotsugu Sakata; Masao Ozu, all of Tokyo, Japan

[73] Assignee: Kabushiki Kaisha Toshiba, Kawasaki, Japan

[21] Appl. No.: 709,295

[22] Filed: Sep. 9, 1996

[51] Int. Cl.[6] ..... F01C 1/04; F01C 11/00

[52] U.S. Cl. ..... 418/55.2; 418/55.3; 418/55.4; 418/60

[58] Field of Search ..... 418/55.2, 55.3, 418/55.4, 60

[56] References Cited

U.S. PATENT DOCUMENTS 4,990,071 2/1991 Sugimoto ..... 418/55.2

5,304,047 4/1994 Shibamoto ..... 418/55.2

5,336,068 8/1994 Sekiya et al. ..... 418/55.2

*Primary Examiner*—John J. Vrablik

*Attorney, Agent, or Firm*—Foley & Lardner

[57] ABSTRACT

A fluid machine has-two working mechanisms. Each of the working mechanisms has a fixed spiral, a movable spiral, and a working chamber. The fixed spiral has an inner contact face that spirals from the periphery toward the center of the fixed spiral and has a stepped shape in section. The movable spiral has an outer contact face that spirals upwardly from the periphery toward the center of the movable spiral and has a stepped shape in section. The movable spiral orbits inside the fixed spiral when an eccentric shaft rotates. The working chamber is defined between the inner and outer contact faces. The height and width of the working chamber become smaller as the working chamber shifts from the periphery toward the center of the working mechanism according to the oscillation of the movable spiral.

16 Claims, 23 Drawing Sheets

0°

90°

270°

180°

FLUID MACHINE HAVING TWO SPIRAL WORKING MECHANISMS WITH A STEPPED SHAPE SECTION

BACKGROUND OF THE INVENTION

1. Field of the Invention

The present invention relates to fluid machines such as compressors, expanders, and pumps.

2. Description of the Prior Art

A scroll compressor is one such fluid machine.

The scroll compressor has a fixed scroll having a fixed spiral and a revolving scroll having a revolving spiral. The fixed and revolving spirals engage with each other. The revolving scroll is revolved with respect to the fixed scroll, to form a compression chamber whose volume is gradually reduced from the periphery toward the center of the compressor, to compress fluid. The compressed fluid is discharged from a discharge port formed at the center of the compressor.

The scroll compressor compresses fluid in a radial direction from the periphery toward the center of the compressor, and the displacement of the compressor is determined by the radius of the revolving scroll. To increase the displacement, the compressor must be enlarged. The fixed and revolving spirals provide inner and outer engaging faces. Since these faces engage with each other, they must be processed precisely. The scroll compressor, has problems in processing and sealing these faces.

It is a desirable to provide a fluid machine, such as a compressor, that is compact and capable of providing a large displacement, improved compression efficiency, low vibration, and high reliability.

SUMMARY OF THE INVENTION

An object of the present invention is to provide a compact fluid machine without the voted drawback.

Another object of the present invention is to provide a fluid machine having a large displacement and improved compression efficiency.

Still another object of the present invention is to provide a fluid machine of low vibration.

Still another object of the present invention is to provide a reliable fluid machine.

Still another object of the present invention is to provide a fluid machine capable of reducing the sliding motions of seals, to improve the reliability and sealing performance of the seals.

Still another object of the present invention is to provide a fluid machine capable of balancing thrust force and gas pressure, to reduce vibration and realize smooth operation.

Still another object of the present invention is to provide a fluid machine that is easy to process and assemble and inexpensive.

In order to accomplish the objects, the present invention provides a fluid machine having a casing, a rotary shaft attached to the casing, an eccentric shaft supported by the rotary shaft, and two working mechanisms axially arranged around the eccentric shaft. Each of the working mechanisms has a fixed spiral, a movable spiral, and a working chamber. The fixed spiral has an inner contact face that spirals from the periphery toward the center of the fixed spiral and has a stepped shape in section. The movable spiral has an outer contact face that spirals upwardly from the periphery toward the center of the movable spiral and has a stepped shape in section. The movable spiral orbits inside the fixed spiral according to the rotation of the eccentric shaft. The working chamber is defined between the inner and outer contact faces. The height and width of the working chamber become smaller as the working chamber shifts from the periphery toward the center of the working mechanism according to the oscillation of the movable spiral.

DETAILED DESCRIPTION OF THE EMBODIMENTS

A fluid machine according to an embodiment of the present invention will be explained with reference to FIGS. 1 to 7.

Figure 1:
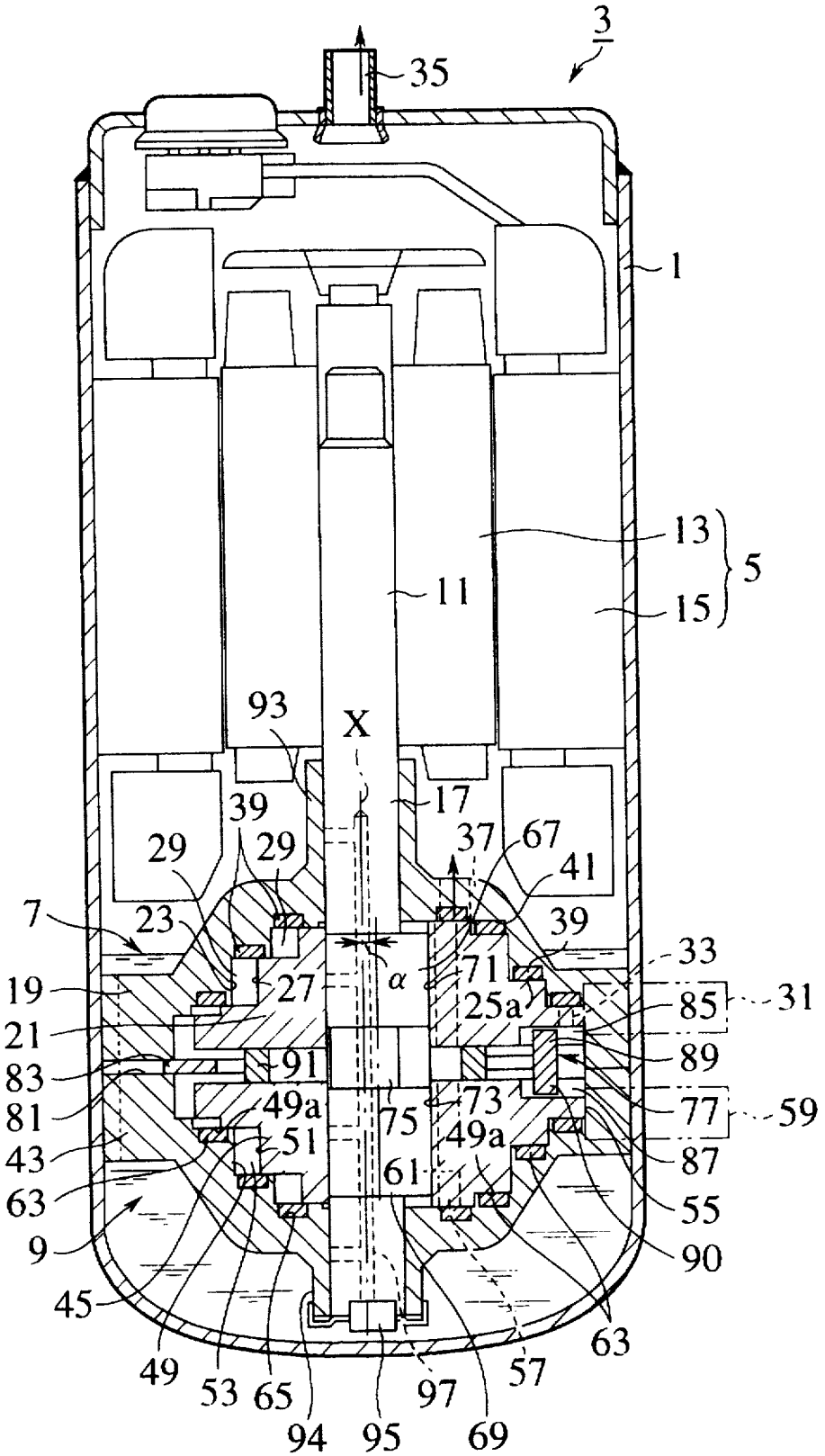
FIG. 1 is a section showing a fluid machine including Oldham ring according to the present invention.

FIG. 1 shows the fluid machine 3, which serves as a compressor. The fluid machine may be an expander or a pump.

The fluid machine 3 has a closed casing 1. The casing 1 accommodates a drive motor 5 and first and second working mechanisms 7 and 9 that are axially arranged.

The motor 5 has a rotor 13 fixed to a main shaft 11 and a stator 15 fixed to the inner wall of the casing 1. The stator 15 receives electricity to rotate the rotor 13, which drives the shaft 11.

The working mechanisms 7 and 9 are vertically arranged around a main shaft 17.

The working mechanism 7 has a fixed spiral 19 and a movable spiral 21.

The fixed spiral 19 is fixed to the inner wall of the casing 1 and has an inner spiral contact face 23 that is formed from the periphery toward the center of the spiral 19. The radius of the contact face 23 gradually decreases from bottom to top of the spiral 19, to define a spiral chamber.

Figure 2:
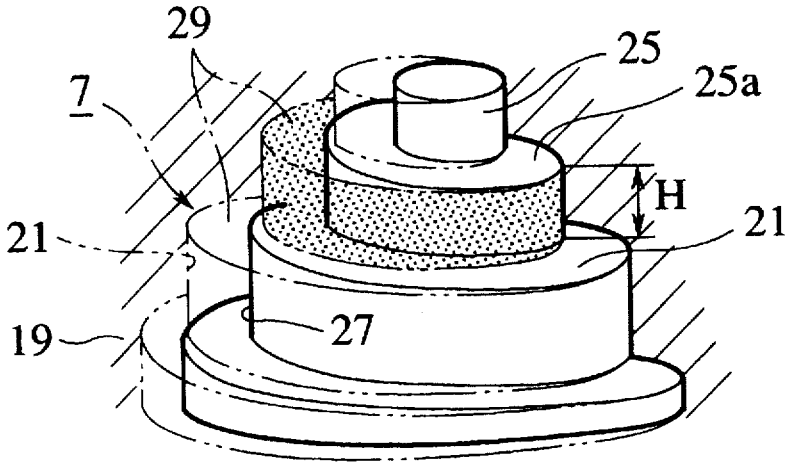
FIG. 2 shows a first working mechanism of the fluid machine of FIG. 1.
Figure 3A:
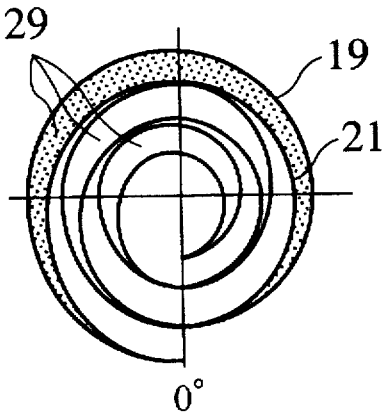
FIGS. 3A to 3D show the compressing operation of the first working mechanism of FIG. 2.
Figure 3B:
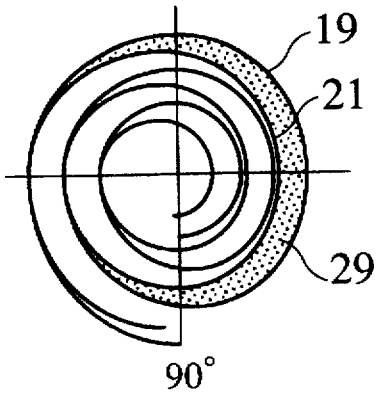
Figure 3D:
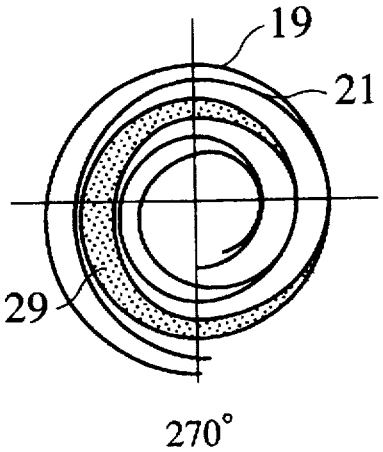
Figure 3C:
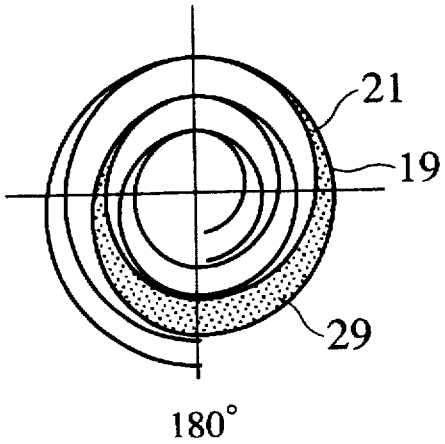

FIG. 2 shows the details of the movable spiral 21. The movable spiral 21 has a spiral body 25 that rises from the periphery toward the center thereof with its radius gradually decreasing. The periphery of the spiral body 25 forms an outer contact face 27.

The inner contact face 23 of the fixed spiral 19 and the outer contact face 27 of the movable spiral 21 get in touch with each other, to define a working chamber (compression chamber) 29.

FIG. 3 shows the plane compressing operation of the working mechanism 7. The movable spiral 21 orbits inside the fixed spiral 19 and is in contact with the fixed spiral 19 at a start point, i.e., at a 0-degree point in FIG. 3(*a*), at a 90-degree point in FIG. 3(*b*), at a 180-degree point in FIG. 3(*c*), and at a 270-degree point in FIG. 3(*d*).

The working chamber 29 has a suction port 33 and a discharge port 37. The suction port 33 is directly connected to a suction pipe 31, which extends outside the casing 1. The discharge port 37 is open to an inner space of the casing 1, which communicates with a discharge pipe 35 connected to the top of the casing 1.

The displacement of the working chamber 29 is determined by the radius and pitch H thereof. The working chamber 29 is sealed with a seal 39. The seal 39 is fitted in a spiral groove 41 formed on a step of the inner contact face 23 of the fixed spiral 19. The seal 39 can protrude from and retract into the groove 41. A top face 25a of the spiral body 25 slides along the seal 39, to keep sealing the working chamber 29.

When the movable spiral 21 orbits inside the fixed spiral 19, the suction port 33 draws a working gas, which is compressed in the working chamber 29, is conveyed toward the discharge port 37, and is discharged from the port 37 into the casing 1.

It is preferable to provide the suction port 33 or discharge port 37 with a check valve (not shown) to prevent the gas from flowing backward.

The gas may be a natural coolant gas such as commercial propane or carbon dioxide or fluorine-based coolant gas for an air conditioner.

The second working mechanism 9 has a fixed spiral 43 and a movable spiral 45. The fixed spiral 43 has an inner spiral contact face 47 that is formed from the periphery toward the center of the spiral 43. The radius of the inner contact face 43 gradually decreases from top to bottom, to define a spiral chamber. The spiral chambers of the mechanisms 7 and 9 are identical in shape and opposite in winding direction. The fixed spiral 43 is fixed to the inner wall of the casing 1.

Figure 4:
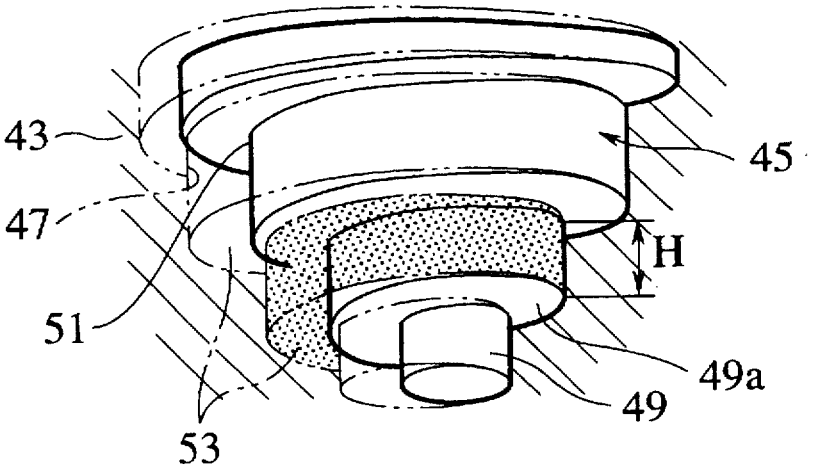
FIG. 4 shows a second working mechanism of the fluid machine of FIG. 1.
Figure 5A:
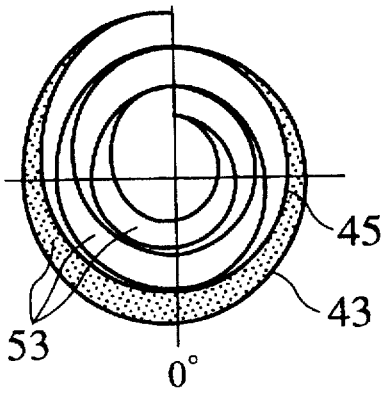
FIGS. 5A to 5D show the compressing operation of the second working mechanism of FIG. 4.
Figure 5B:
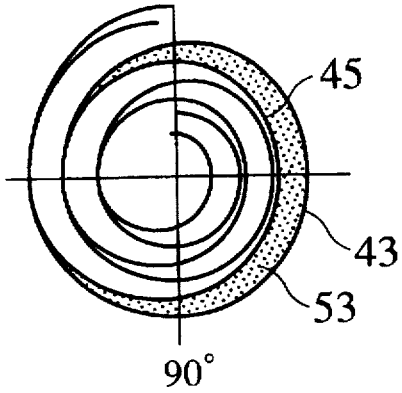
Figure 5D:
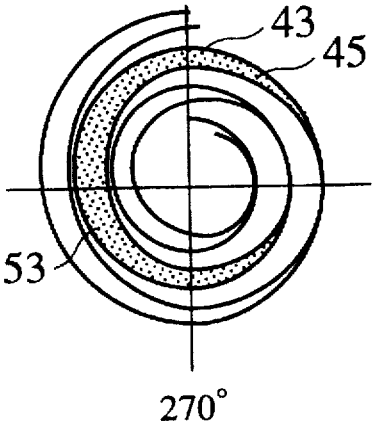
Figure 5C:
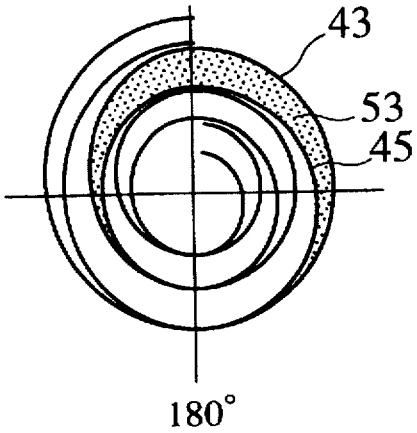

FIG. 4 shows the details of the movable spiral 45. The movable spiral 45 has a spiral body 49 that narrows from the periphery toward the center thereof. The spiral bodies 25 and 49 of the mechanisms 7 and 9 are identical in shape and opposite in winding direction. The periphery of the spiral body 49 forms an outer contact face 51.

The inner contact face 47 of the fixed spiral 43 and the outer contact face 51 of the movable spiral 45 contact each other, to define a working chamber (compression chamber) 53.

FIG. 5 shows the plane compressing operation of the second working mechanism 9. The movable spiral 45 orbits inside the fixed spiral 43 and is in contact with the fixed spiral 43 at a start point, i.e., at a 0-degree point in FIG. 5(*a*), at a 90-degree point in FIG. 5(*b*), at a 180-degree point in FIG. 5(*c*), and at a 270-degree point in FIG. 5(*d*).

The working chamber 53 has a suction port 55 and a discharge port 57. The suction port 55 is directly connected to a suction pipe 59, which extends outside the casing 1.

The discharge port 57 communicates with a path 61, which passes through the movable spirals 45 and 21 and is open to the inner space of the casing 1, which communicates with the discharge pipe 35 arranged at the top of the casing 1.

The displacement of the working chamber 53 is determined by the radius and pitch H thereof. The working chamber 53 is sealed with a seal 63. The seal 63 is fitted in a spiral groove 65 formed on a step of the inner contact face 47 of the fixed spiral 43. The seal 63 can protrude from and retract into the groove 65. A top face 49*a* of the spiral body 49 slides along the seal 63, to keep sealing the working chamber 53.

When the movable spiral 45 orbits inside the fixed spiral 43, the suction port 55 draws a working gas, which is compressed in the working chamber 53, is conveyed toward the discharge port 57, and is discharged from the port 57 into the casing 1.

It is preferable to provide the suction port 55 or discharge port 57 with a check valve (not shown) to prevent the gas from flowing backward.

The main shaft 17 passes through the working mechanisms 7 and 9 and is integrally connected with the shaft 11 of the motor 5. The main shaft 17 has first and second eccentric shafts 67 and 69 that deviate from a center axis X by $\alpha$. The eccentric shafts 67 and 69 rotatably support bearings 71 and 73 of the movable spirals 21 and 45, respectively.

An intermediate shaft 75 is formed between the eccentric shafts 67 and 69. The diameter of the intermediate shaft 75 is smaller than that of the eccentric shafts 67 and 69. The center axis of the intermediate shaft 75 is equal to the center axis X of the main shaft 17, to realize balanced rotation.

When the eccentric shafts 67 and 69 are turned, the movable spirals 21 and 45 orbit inside the fixed spirals 19 and 43 through an Oldham ring 77.

Figure 6:
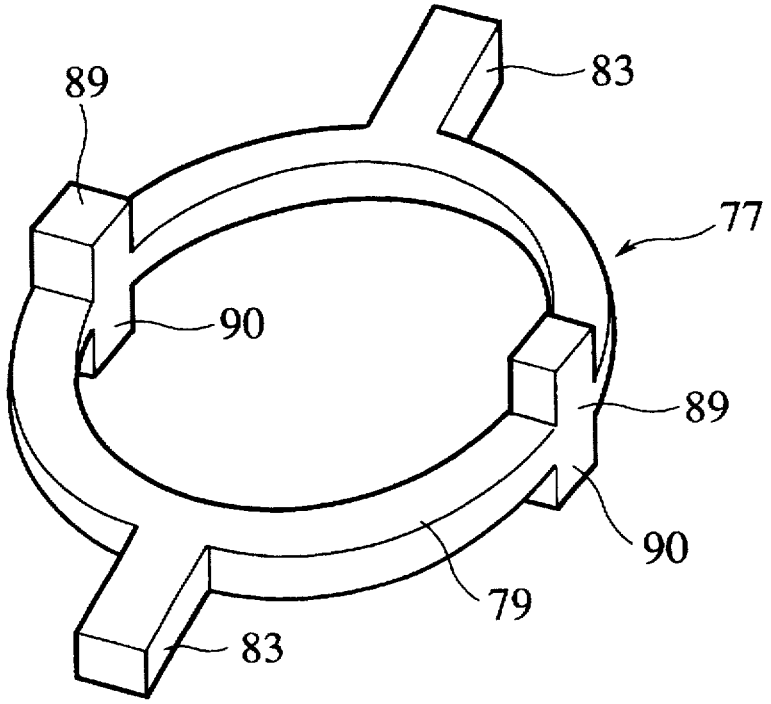
FIG. 6 is a perspective view showing an Oldham ring of the fluid machine of FIG. 1.

FIG. 6 shows the Oldham ring 77. The ring 77 consists of an annular body 79, a pair of projections 83 oppositely protruding from the body 79, and pairs of projections 89 and 90. The projections 83 fit into grooves 81 formed on the fixed spirals 19 and 43. The projections 89 and 90 fit into grooves 85 and 87 formed on the movable spirals 21 and 45. There are spaces between the projections 89 and 90 and the grooves 85 and 87.

A thrust ring 91 is arranged in the Oldham ring 77. An oil pump 95 supplies lubricant through a lubricant path 97 to the bearings 71 and 73 of the movable spirals 21 and 45 around the eccentric shafts 67 and 69 and to bearings 93 and 94 of the fixed spirals 19 and 43 around the main shaft 17.

The suction ports 33 and 55 draw a working gas, which is compressed in the working chambers 29 and 53 whose volumes are reduced in horizontal and vertical directions according to the oscillating motions of the movable spirals 21 and 45. The compressed gas is discharged from the discharge ports 37 and 57 into the casing 1. The gas in the casing 1 is discharged outside through the discharge pipe 35.

Figure 7:
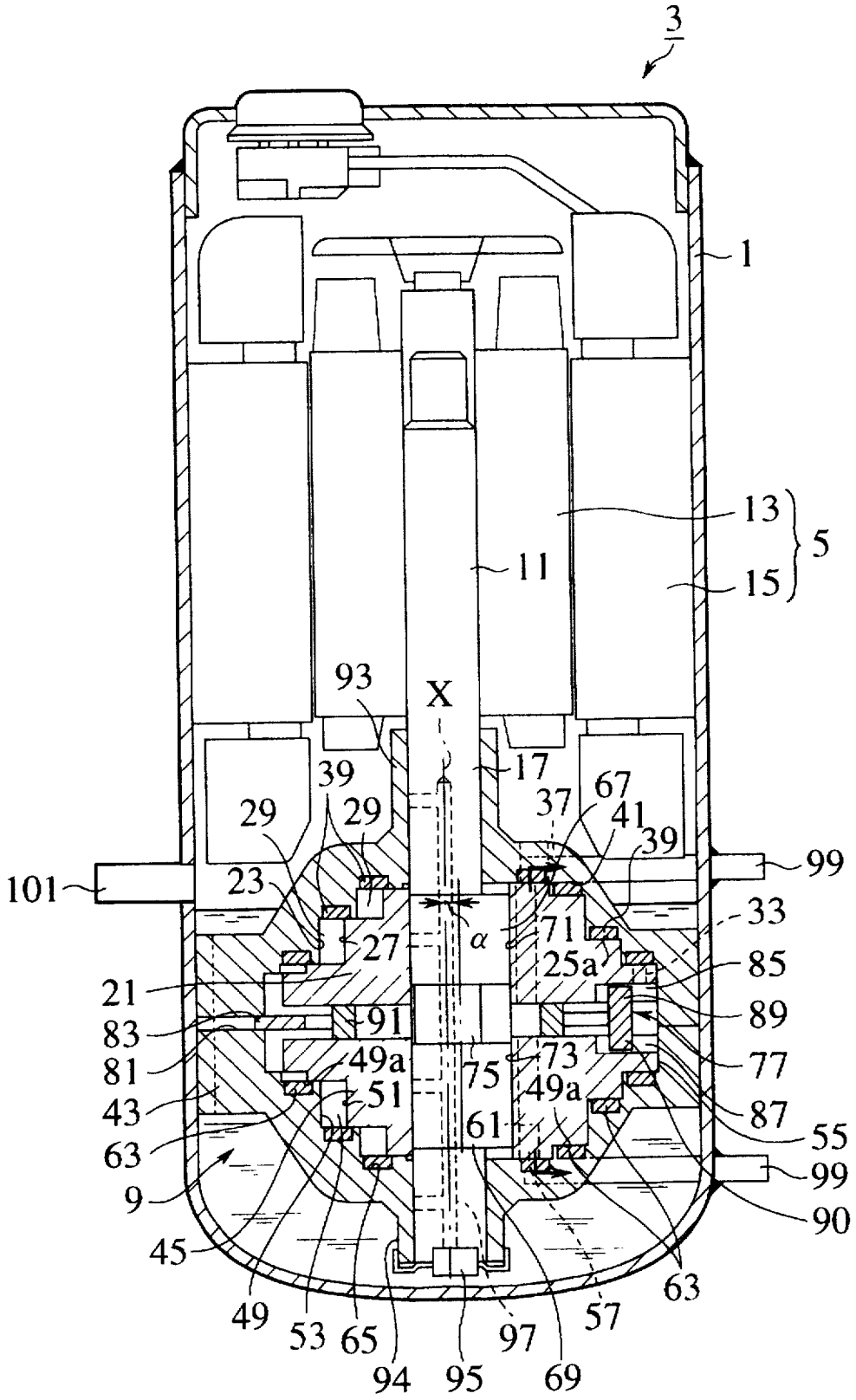
FIG. 7 is a section showing a fluid machine including Oldham ring based on the machine of FIG. 1, having a low-pressure casing.

Since the compressed gas is discharged into the casing 1, the casing 1 is a high-pressure casing. The casing 1 may be a low-pressure casing 1 as shown in FIG. 7. In this case, the discharge ports 37 and 57 are directly connected to discharge pipes 99 that extend outsides the casing 1. A suction pipe 101 is formed on the casing 1, to draw working gas into the casing 1. The gas is then compressed in the working chambers 29 and 53 and is directly discharged outside through the discharge pipes 99.

The vertically arranged twin working chambers 29 and 53 are advantageous in reducing the sizes of the working mechanisms 7 and 9, compared with a fluid machine having a single working chamber. This advantage results in reducing the sliding motions and wear of the seals 39 and 63, to keep sealing the working chambers 29 and 53 for a long time and improve the reliability of the fluid machine 3.

Thrusting forces applied to the backs of the movable spirals 21 and 45 balance each other relative to the axial direction X, and the eccentric shafts 67 and 69 balance each other relative to the axial direction X, to reduce vibration. Even if the movable spirals 21 and 45 move axially, they never interfere with the intermediate shaft 75, to secure smooth operation.

Figure 8:
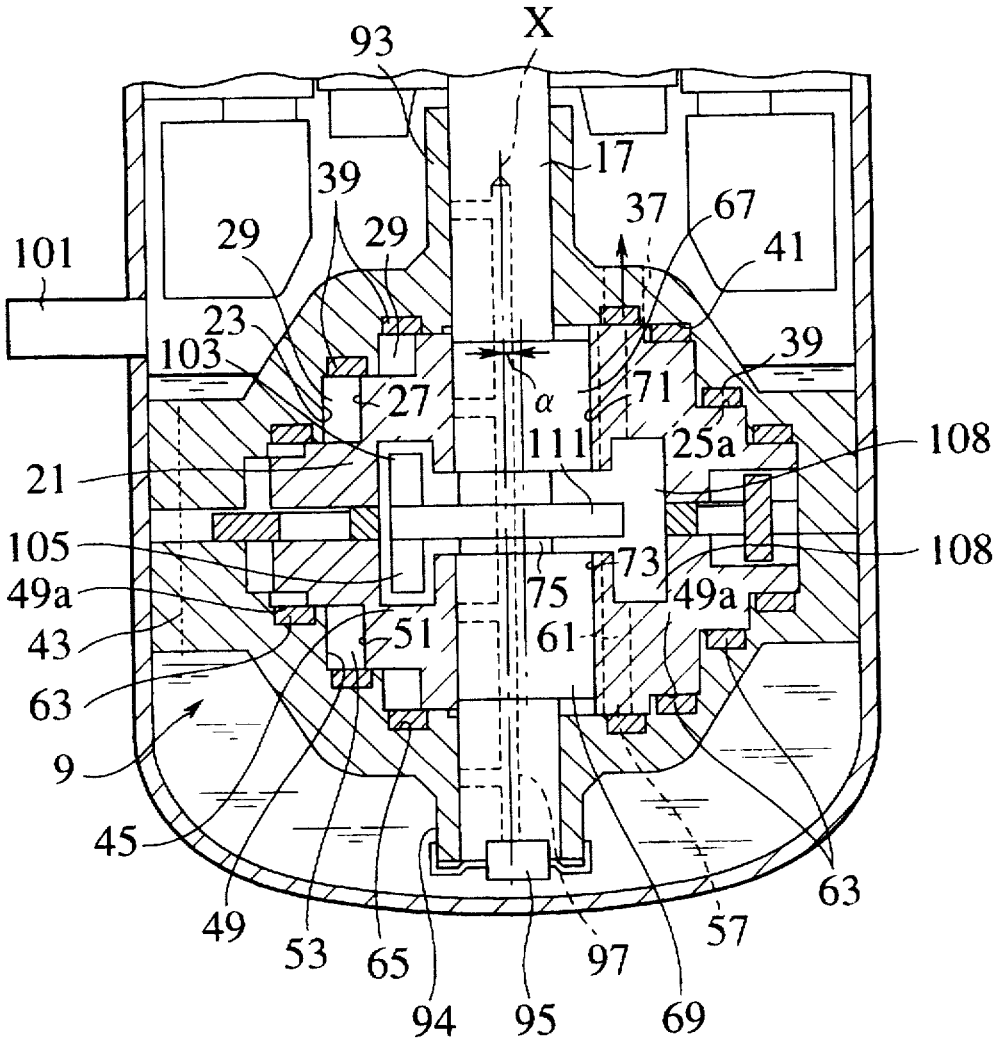
FIG. 8 is a section showing a fluid machine based on the machine of FIG. 1, having balancers.

FIG. 8 shows balancers 103 and 105 provided for the fluid machine of FIG. 1, to realize stable operation.

Balancer spaces 108 are formed in the movable spirals 21 and 45, to accommodate the balancers 103 and 105.

The balancers 103 and 105 are supported by a support 111, which passes through the intermediate shaft 75. The balancers 103 and 105 are arranged 180 degrees opposite to the eccentric shafts 67 and 69, i.e., the eccentricity of the movable spirals 21 and 45.

The other parts of FIG. 8 are the same as those of FIG. 1 and are represented with like reference numerals to omit their explanations.

The balancers 103 and 105 will balance and smoothly orbit the movable spirals 21 and 45 inside the fixed spirals 19 and 43. Since the balancers 103 and 105 are disposed inside the movable spirals 21 and 45, the fluid machine 3 is compact. The balancer support 111 is separate from the main shaft 17, so that the main shaft 17 may be thin and processed in a short time.

Figure 9:
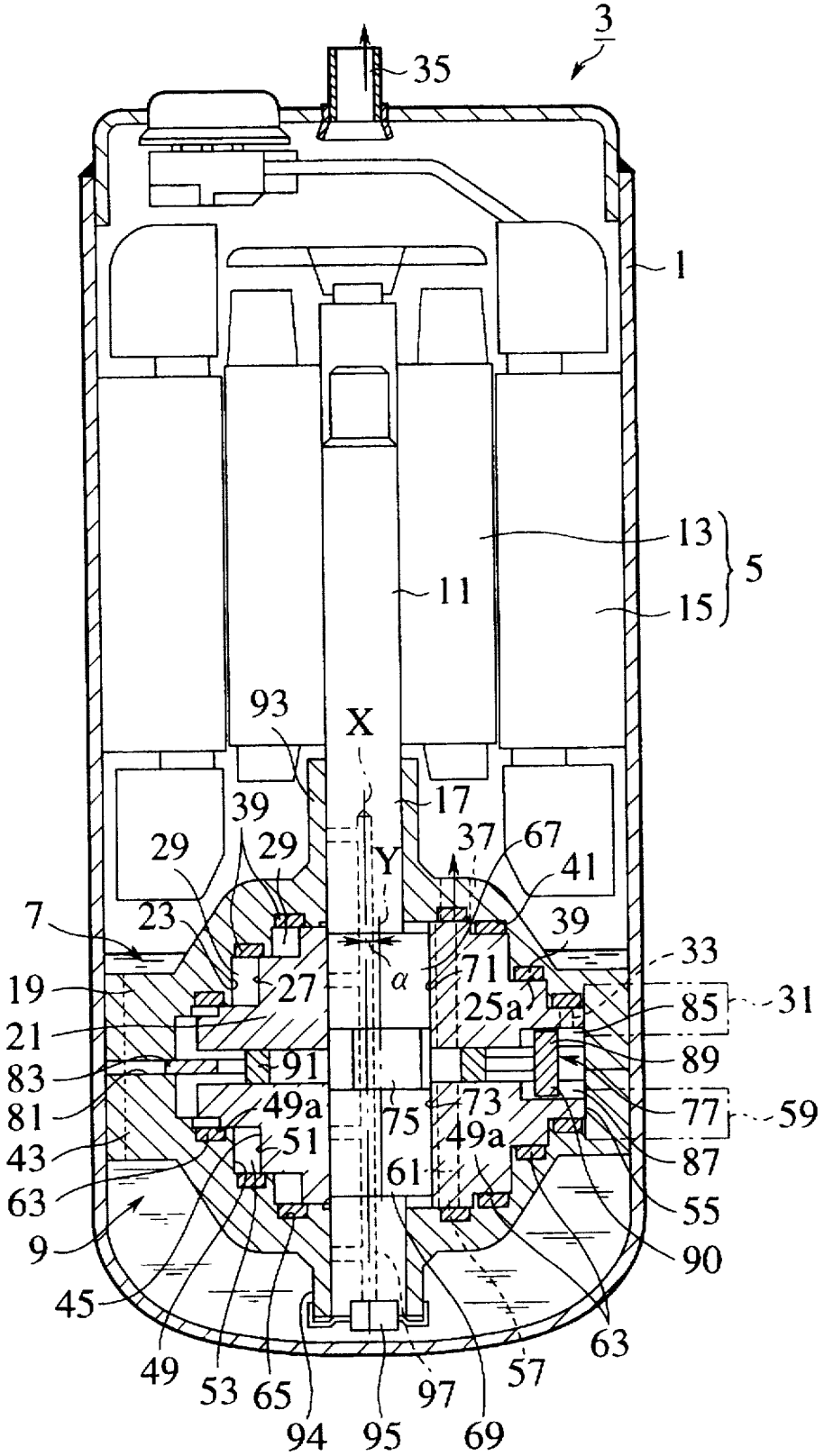
FIG. 9 is a section showing a fluid machine based on the machine of FIG. 1, having a modified intermediate shaft.

FIG. 9 shows a fluid machine based on the machine of FIG. 1, having a modified intermediate shaft 75. The diameter of the intermediate shaft 75 is smaller than that of the eccentric shafts 67 and 69, and the center axis of the intermediate shaft 75 is aligned with the center axis Y of the eccentric shafts 67 and 69. The other parts of FIG. 9 are the same as those of FIG. 1 and are represented with like reference numerals to omit their explanations.

The fluid machine of FIG. 9 is advantageous in simultaneously processing the eccentric shafts 67 and 69 and intermediate shaft 75.

Figure 10:
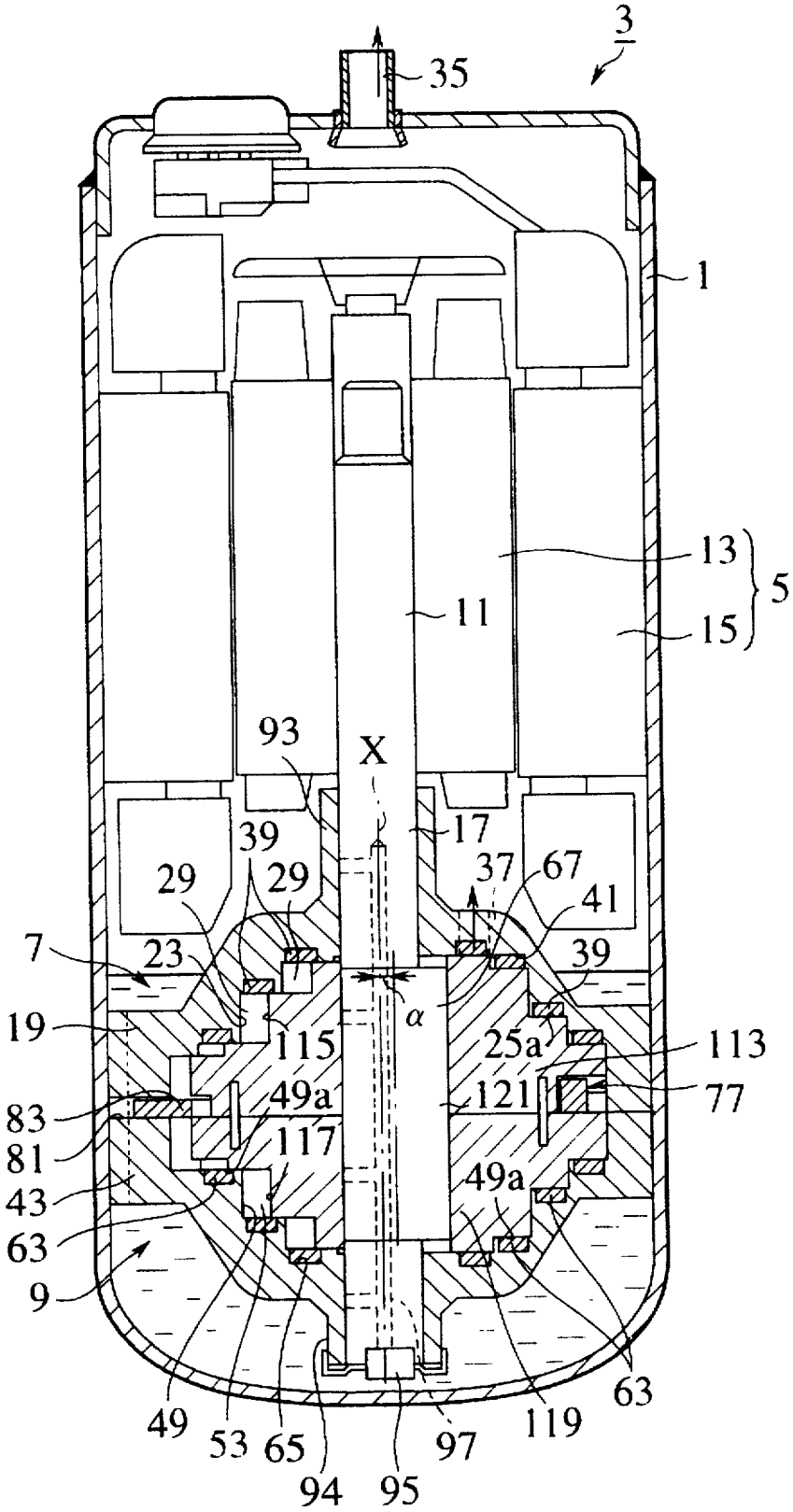
FIG. 10 is a section showing a fluid machine based on the machine of FIG. 1, having an integrated movable spiral.

FIG. 10 shows a fluid machine based on the machine of FIG. 1, having a single movable spiral 113.

The single movable spiral 113 serves for both the working mechanisms 7 and 9. The top half of the movable spiral 113 forms an outer spiral contact face 115 and the bottom half thereof forms an outer spiral contact face 117. The contact face 115 is in touch with the inner contact face 23 of the fixed spiral 19 of the working mechanism 7. The contact face 117 is in touch with the inner contact face 47 of the fixed spiral 43 of the second working mechanism 9. The contact faces 23, 47, 115, and 117 have the same shapes as those of FIG. 1.

The movable spiral 113 has a bearing 119, which is rotatably fitted around an eccentric shaft 121 that is integral with the main shaft 17. The eccentric shaft 121 may have a recess (not shown) at about the middle thereof. The recess is away from the movable spiral 113, to reduce a frictional loss and improve oscillation efficiency.

The Oldham ring 77 is arranged around the center of the movable spiral 113 so that the movable spiral 113 may orbit inside the fixed spirals 19 and 43 according to the rotation of the eccentric shaft 121. One of the two pairs of projections 89 and 90 of the Oldham ring 77 may be omitted because the movable spiral 113 is single. This may simplify the processing of the Oldham ring 77.

The other parts of FIG. 10 are the same as those of FIG. 1 and are represented with like reference numerals to omit their explanations.

The fluid machine of FIG. 10 reduces the number of parts, is easy to assemble, and realizes smooth oscillating motions.

Figure 11:
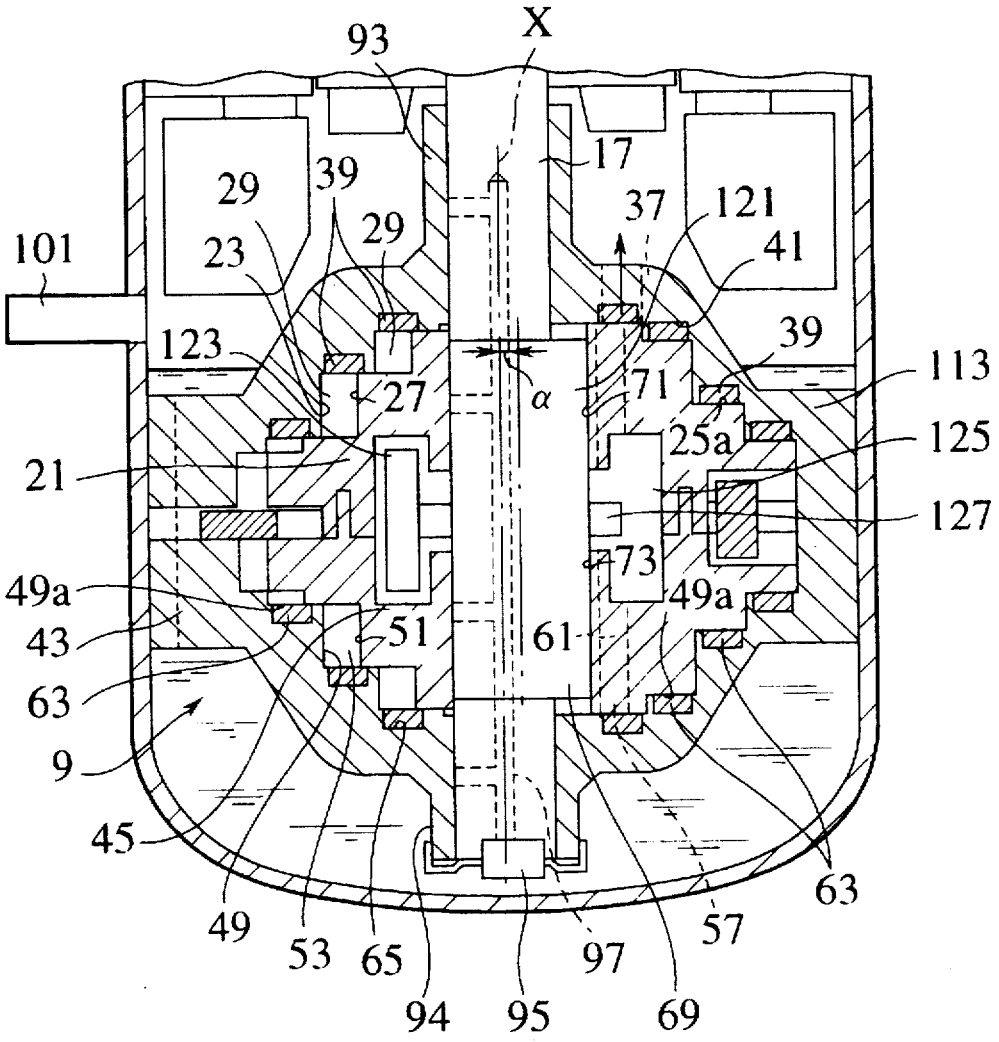
FIG. 11 is a section showing a fluid machine based on the machine of FIG. 10, having a balancer.

FIG. 11 shows the fluid mechanism of FIG. 10 provided with a balancer 123 to stabilize the oscillating motions of the movable spiral 113 inside the fixed spirals 19 and 43.

A balancer space 125 is formed inside the movable spiral 113, to accommodate the balancer 123.

The balancer 123 is supported by a balancer support 127, which passes through the eccentric shaft 121. The balancer 123 is arranged 180 degrees opposite to the eccentric shaft 121, i.e., the eccentricity of the movable spiral 113.

The other parts of FIG. 11 are the same as those of FIG. 10 and are represented with like reference numerals to omit their explanations.

The balancer 123 stabilizes and smooths the operation of the movable spiral 113. Since the balancer 123 is disposed inside the movable spiral 113, the fluid machine is compact.

FIGS. 12 to 16 show a fluid machine based on the machine of FIG. 1, having movable spirals 21 and 45 that are eccentric in 180 degrees opposite directions.

The working mechanism 7 has a first eccentric shaft 67, the movable spiral 21, and the fixed spiral 19. The second working mechanism 9 has a second eccentric shaft 69, the movable spiral 45, and the fixed spiral 43. The eccentric shaft 67 and movable spiral 21 are 180 degrees opposite in eccentricity from the eccentric shaft 69 and movable spiral 45.

Figure 12:
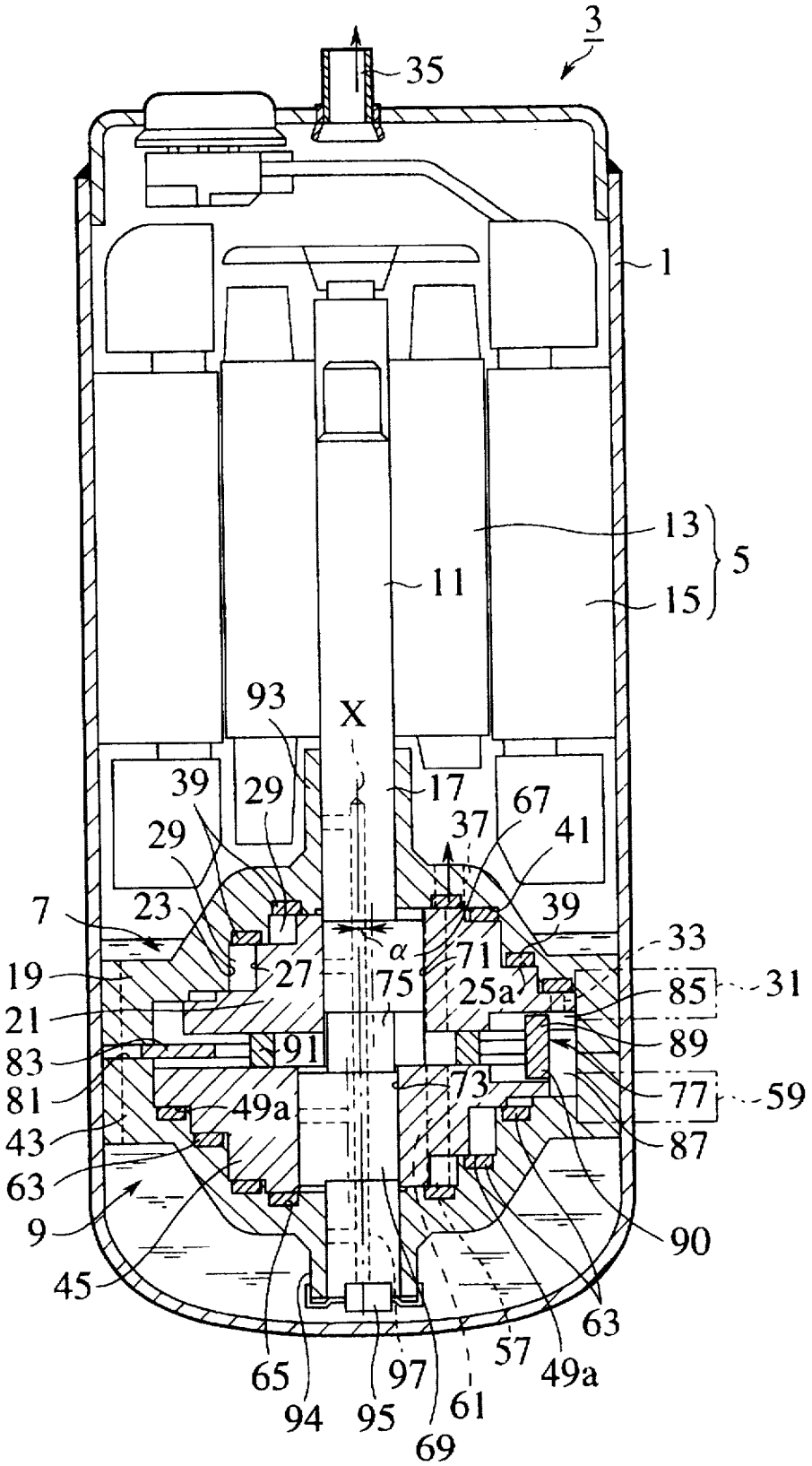
FIG. 12 is a section showing a fluid machine including Oldham ring based on the machine of FIG. 1, having movable spirals that are eccentric in 180 degrees opposite directions.
Figure 13:
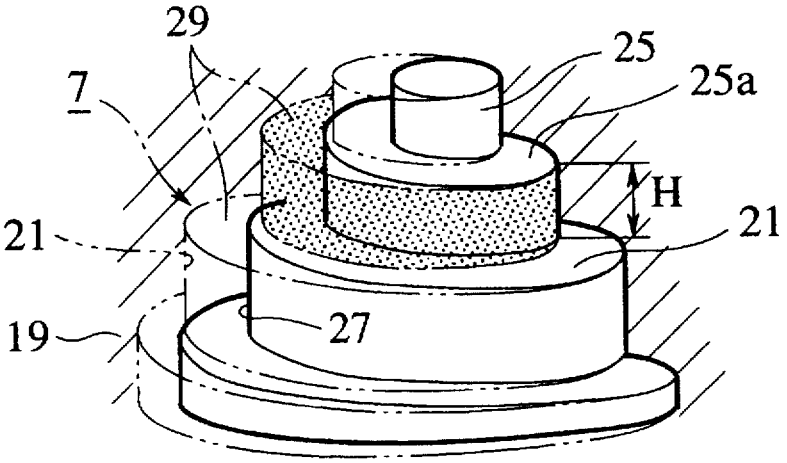
FIG. 13 shows a first working mechanism of the fluid machine of FIG. 12.
Figure 14A:
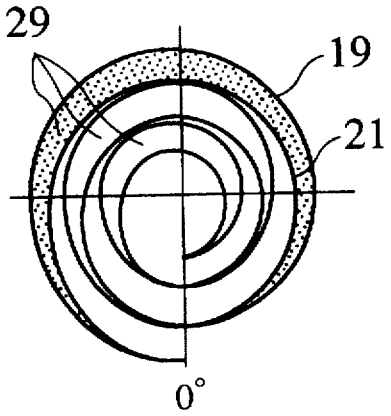
FIGS. 14A to 14D show the compressing operation of the first working mechanism of FIG. 13.
Figure 14B:
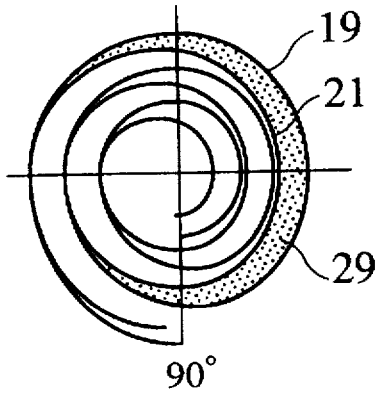
Figure 14D:
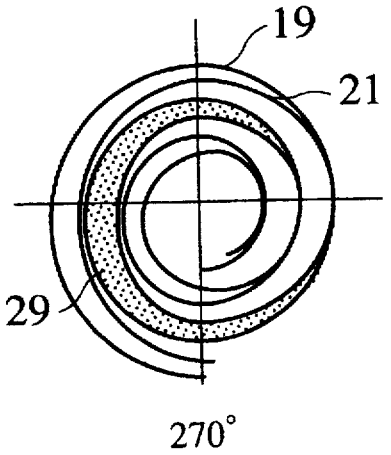
Figure 14C:
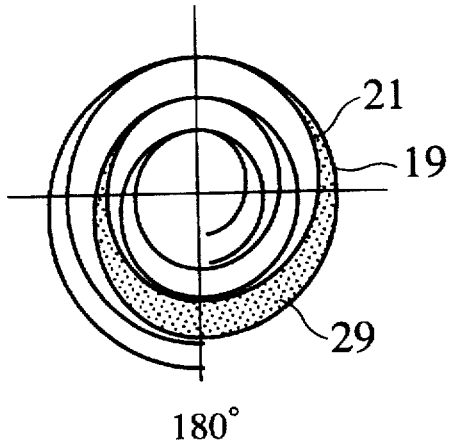
Figure 15:
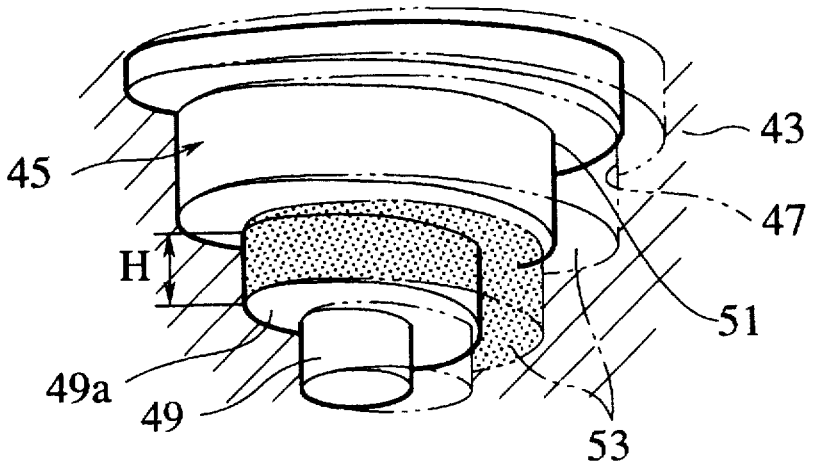
FIG. 15 shows a second working mechanism of the fluid machine of FIG. 12.
Figure 16A:
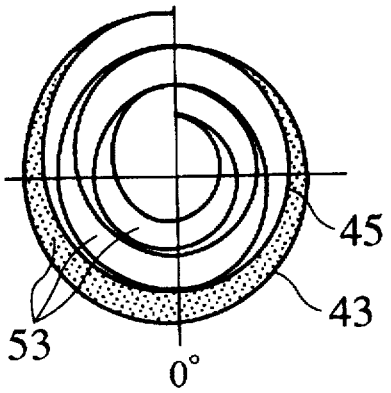
FIGS. 16A to 16D show the compressing operation of the second working mechanism of FIG. 15.
Figure 16B:
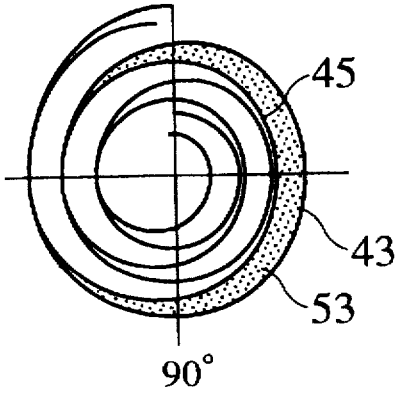
Figure 16D:
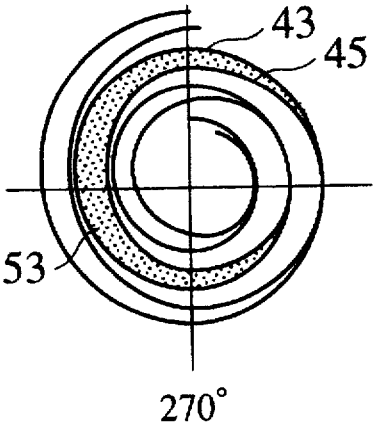
Figure 16C:
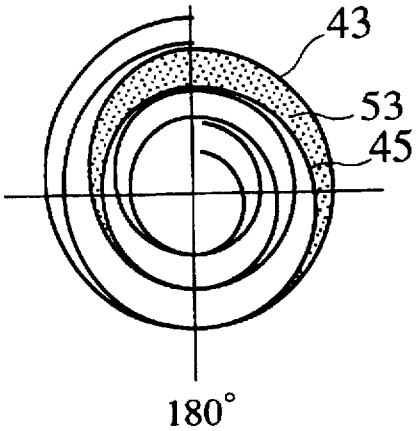

The other parts of FIG. 12 are the same as those of FIG. 1 and are represented with like reference numerals to omit their explanations.

The suction ports 33 and 55 draw a working gas, which is compressed and conveyed toward the discharge ports 37 and 57, which discharge the compressed gas into the casing 1.

Compressing processes (a) to (d) of the working mechanism 7 of FIG. 14 are shifted by 180 degrees from those of the second working mechanism 9 of FIG. 16. Accordingly, thrusting forces in the mechanisms 7 and 9 partly balance and cancel with each other. Since the mechanisms 7 and 9 involve opposite eccentricity, gas pressures acting on the mechanisms 7 and 9 have the same strength and opposite directions, and therefore, cancel with each other to reduce vibration.

Figure 17:
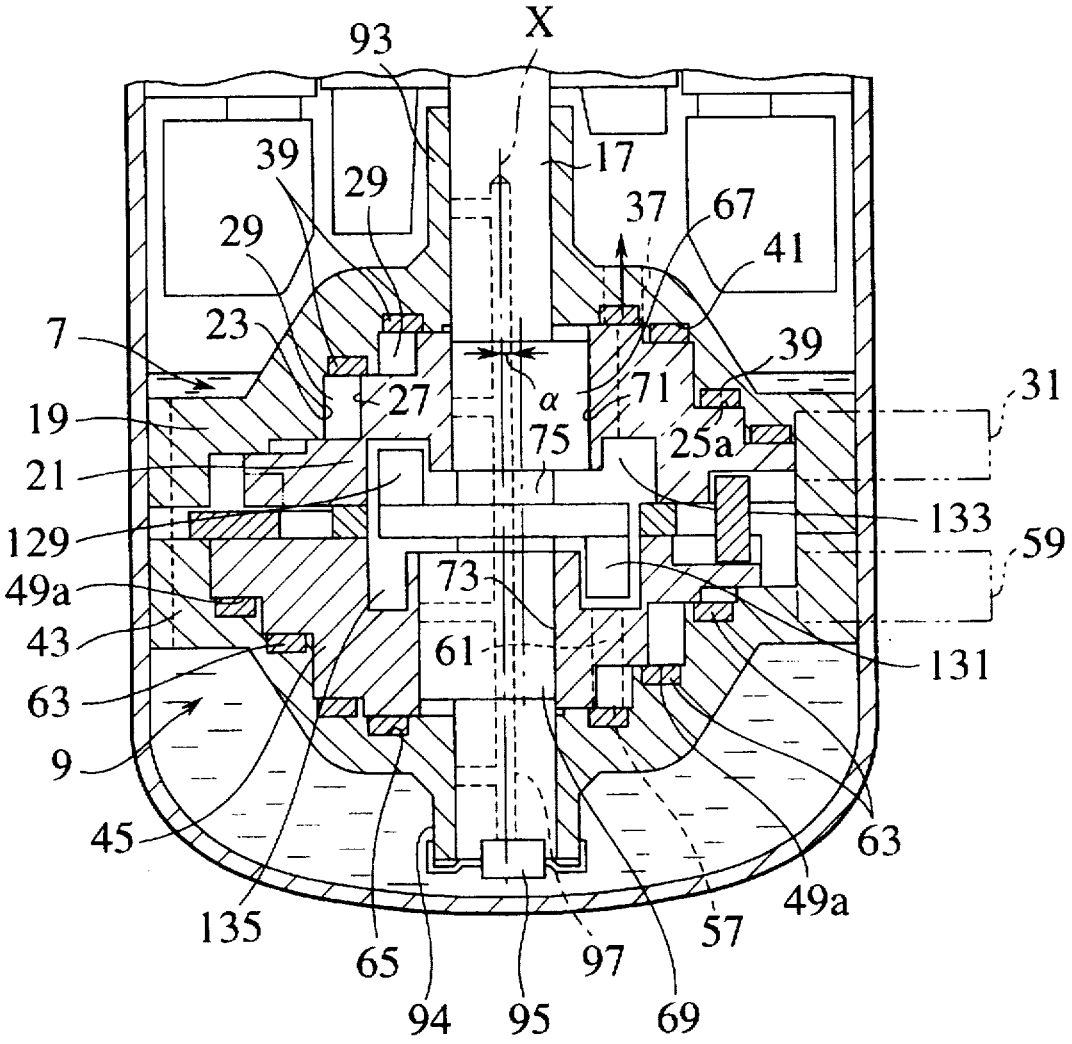
FIG. 17 is a section showing a fluid machine including Oldham ring based on the machine of FIG. 12, having a balancer.

FIG. 17 shows the fluid machine of FIG. 12 provided with balancers 129 and 131.

The movable spirals 21 and 45 have balancer spaces 133 and 135 to accommodate the balancers 129 and 131.

The balancers 129 and 131 are supported by a balancer support 137, which passes through the intermediate shaft 75. The balancer 129 is arranged 180 degrees opposite to the first eccentric shaft 67, i.e., the eccentricity of the movable spiral 21. The balancer 131 is arranged 180 degrees opposite to the second eccentric shaft 69, i.e., the eccentricity of the movable spiral 45.

The other parts of FIG. 17 are the same as those of FIG. 12 and are represented with like reference numerals to omit their explanations.

The balancers 129 and 131 balance and smooth the oscillating operations of the movable spirals 21 and 45 inside the fixed spirals 19 and 43. Since the balancers 129 and 131 are disposed inside the movable spirals 21 and 45, the fluid machine is compact.

FIGS. 18 to 22 show a fluid machine based on the machine of FIG. 1, having 180 degrees opposite suction ports and a common suction path and discharge pipe.

The suction port 33 of the working mechanism 7 and the suction port 55 of the second working mechanism 9 are 180 degrees opposite to each other and are connected to the common suction path 139 and suction pipe 141.

The other parts are the same as those of FIG. 1 and are represented with like reference numerals to omit their explanations.

The suction ports 33 and 55 draw a working gas, which is compressed and conveyed toward the output ports 37 and 57, which discharge the compressed gas into the casing 1.

Compressing processes (a) to (d) of the working mechanism 7 of FIG. 20 are shifted by 180 degrees from those of the second working mechanism 9 of FIG. 22. A thrusting force and gas pressure in the working mechanism 7 partly balance with those in the second working mechanism 9, to cancel each other. The suction path 139 and suction pipe 141 are common to the first and second mechanisms 7 and 9. This is advantageous in reducing the number of parts and costs.

Shifting the compressing processes of the mechanisms 7 and 9 by 180 degrees from each other reduces vibration.

Figure 18:
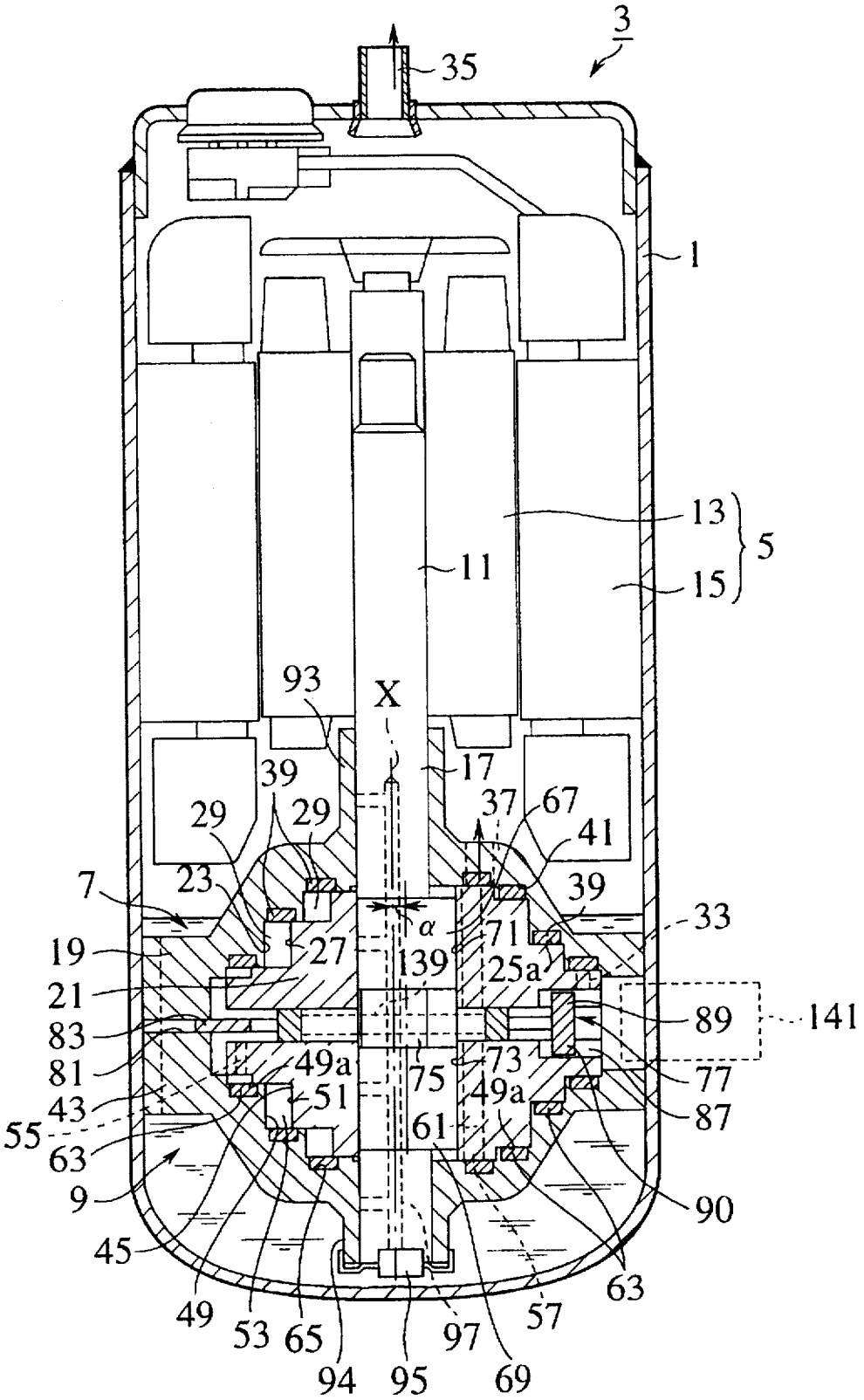
FIG. 18 is a section showing a fluid machine including Oldham ring based on the machine of FIG. 1, having 180 degrees opposite suction ports and a common suction path and discharge pipe.
Figure 19:
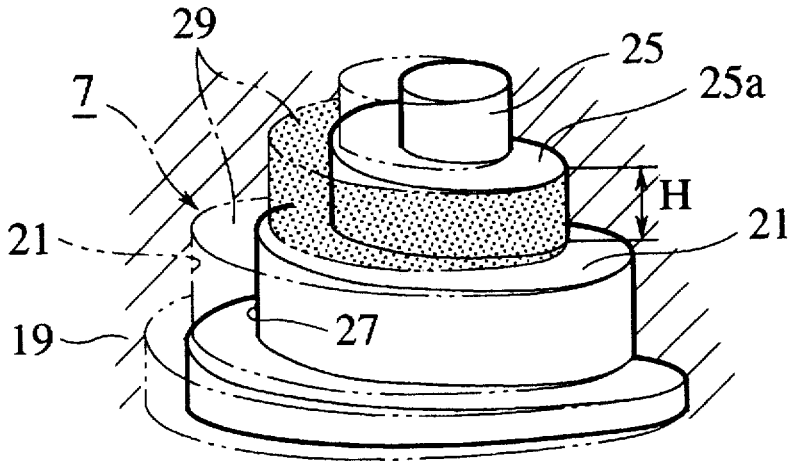
FIG. 19 shows a first working mechanism of the fluid machine of FIG. 18.
Figure 20A:
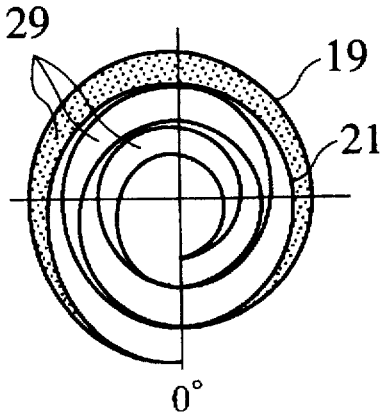
FIGS. 20A to 20D show and the compressing operation of the first working mechanism of FIG. 19.
Figure 20B:
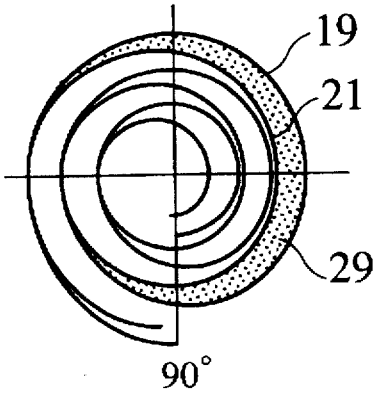
Figure 20D:
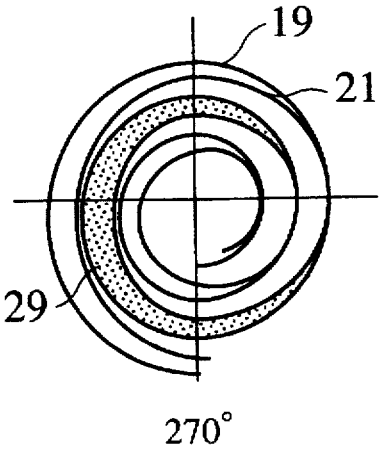
Figure 20C:
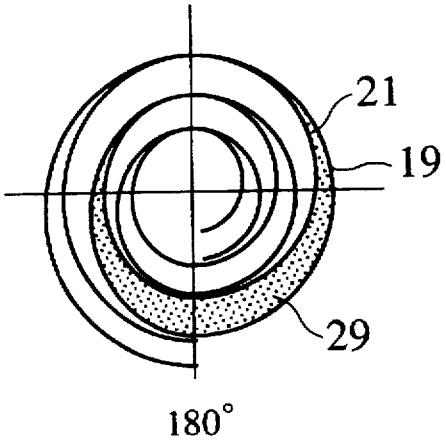
Figure 21:
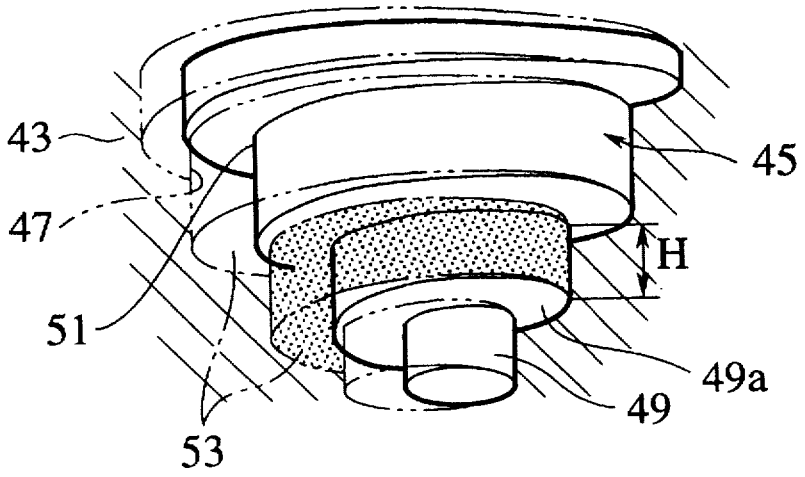
FIG. 21 shows a second working mechanism of the fluid machine of FIG. 18.
Figure 22A:
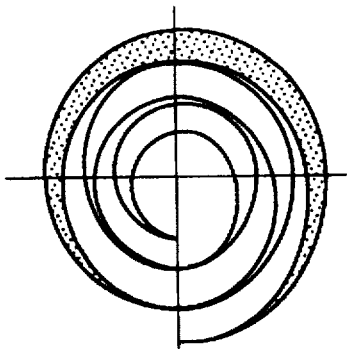
FIGS. 22A to 22D show the compressing operation of the second working mechanism of FIG. 21.
Figure 22B:
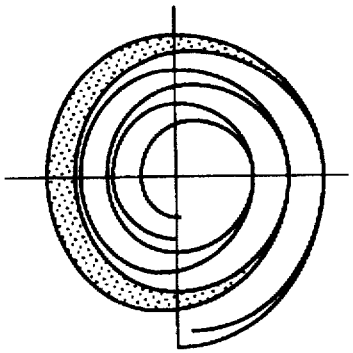
Figure 22D:
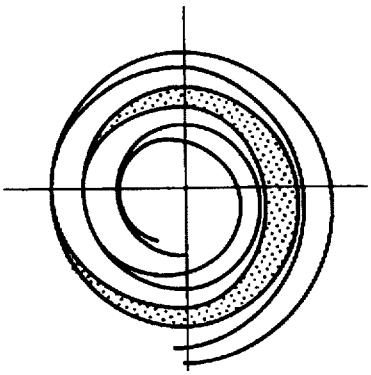
Figure 22C:
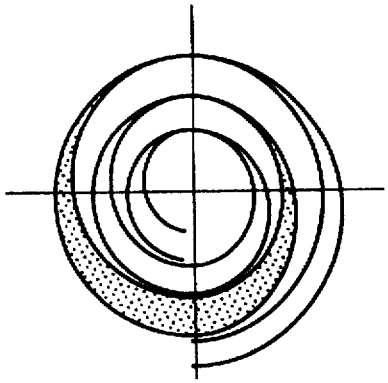
Figure 23:
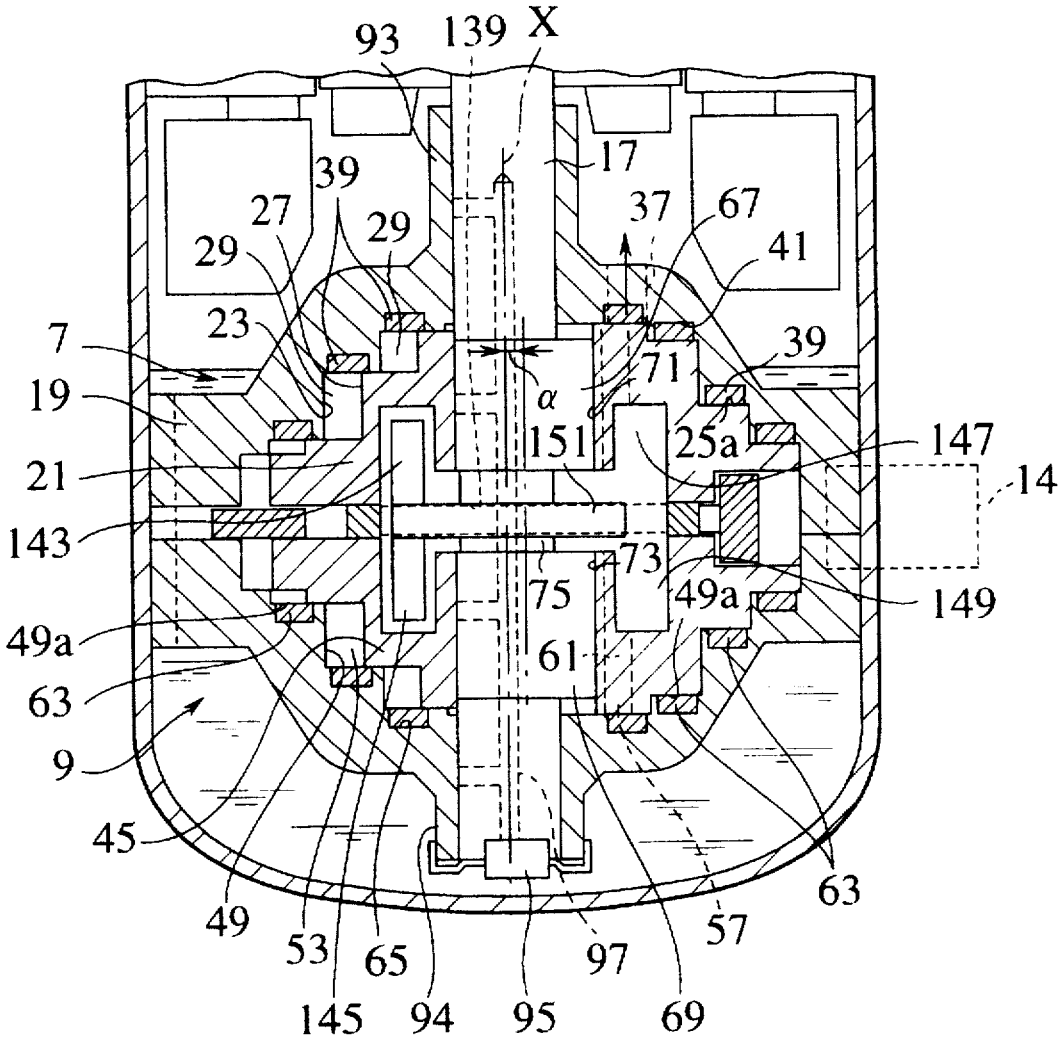
FIG. 23 shows a fluid machine including Oldham ring based on the machine of FIG. 18, having balancers.

FIG. 23 shows the fluid machine of FIG. 18 provided with balancers 143 and 145.

The movable spiral 21 has a balancer space 147 to accommodate the balancer 143. The movable spiral 45 has a balancer space 149 to accommodate the balancer 145.

The balancers 143 and 145 are supported by a balancer support 151 that passes through the intermediate shaft 75. The balancers 143 and 145 are 180 degrees opposite to the eccentric shafts 67 and 69, i.e., the eccentricity of the movable spirals 21 and 45.

The gravity center w of each of the balancers 143 and 145 axially agrees with the gravity center m of a corresponding one of the movable spirals 21 and 45 and with the gravity center n of a corresponding one of the eccentric shafts 67 and 69.

The other parts of FIG. 23 are the same as those of FIG. 18 and are represented with like reference numerals to omit their explanations.

The balancers 143 and 145 balance and smooth the oscillating operations of the movable spirals 21 and 45 inside the fixed spirals 19 and 43. Since the balancers 143 and 145 are disposed inside the movable spirals 21 and 45, the fluid machine is compact. Positioning the gravity centers w, m, and n at the same axial position balances not only centrifugal force but also the moment. This results in reducing load and deflection on the eccentric shafts 67 and 69 during a high-speed operation and improving the reliability of the fluid machine.

What is claimed is:

1. A fluid machine comprising:

a casing;

a rotary shaft rotatably attached to said casing;

eccentric shafts supported by said rotary shaft; and two working mechanisms axially arranged around said eccentric shafts, respectively, each of said working mechanisms comprising:

a fixed spiral having an inner contact face that spirals from the periphery toward the center of said fixed spiral and having a stepped shape section;

a movable spiral having an outer contact face that spirals upwardly from the periphery toward the center of said movable spiral and having a stepped shape section, said movable spiral oscillating inside said fixed spiral according to the rotation of said eccentric shaft; and a working chamber defined between the inner and outer contact faces, the height and width of said working chamber being reduced while said working chamber being shifted from the periphery toward the center of said working mechanism.

2. The fluid machine of claim 1, wherein the inner and outer contact faces of one of said working mechanisms are identical in shape and opposite in winding direction to those of the other working mechanism.

3. The fluid machine of claim 1, wherein said eccentric shafts are eccentric in the same direction so that said movable spirals contact with said respective fixed spirals on the same side.

4. The fluid mechanism of claim 1, further comprising an intermediate shaft is formed between said eccentric shafts, the diameter of the intermediate shaft being smaller than that of said eccentric shafts.

5. The fluid machine of claim 1, further comprising an intermediate shaft formed between said eccentric shafts, a center axis of the intermediate shaft being aligned with a center axis of said rotary shaft.

6. The fluid machine of claim 1, further comprising an intermediate shaft formed between said eccentric shafts, a center axis of the intermediate shaft being aligned with a center axis of said eccentric shafts.

7. The fluid machine of claim 1, wherein said working mechanisms have suction ports, respectively, on the same side, to simultaneously draw working gas.

8. The fluid machine of claim 1, wherein said eccentric shafts are 180 degrees opposite to each other so that said movable spirals contact said respective fixed spirals on the 180 degrees opposite sides.

9. The fluid machine of claim 1, wherein said working mechanisms have suction ports, respectively, on the 180 degrees opposite sides to draw a working gas with a phase difference of 180 degrees.

10. The fluid machine of claim 1, wherein said working mechanisms have suction ports, respectively, on the 180 degrees opposite sides, the suction ports being connected to a common suction path and suction pipe.

11. The fluid machine of claim 1, wherein said casing is a high-pressure casing into which pressurized working gas is discharged, and each of said working mechanisms compresses a working gas from suction side toward a discharge side.

12. The fluid machine of claim 11, wherein working gas discharged from a discharge port of each of said working mechanisms is discharged inside said casing through said movable spirals.

13. The fluid machine of claim 1, wherein said casing is a low-pressure casing to discharge working gas from each discharge port directly to the outside of said casing, and each of said working mechanisms compresses working gas from a suction side toward a discharge side.

14. The fluid machine of claim 1, wherein said movable spirals are integral together.

15. The fluid machine of claim 1, further comprising an Oldham ring arranged between said movable spirals to restrict the rotation of said movable spirals and to orbit said movable spirals inside said fixed spirals.

16. A fluid machine comprising:

first and second fixed spirals each having an inner contact face that spirals from the periphery toward the center of said fixed spiral and having a stepped shape section;

first and second movable spirals each having an outer contact face that spirals upwardly from the periphery toward the center of said movable spiral and having a stepped shape section; and support means for supporting said fixed and movable spirals so that said movable spirals are restricted from rotating with respect to said fixed spirals and so that said movable spirals may orbit inside said fixed spirals according to the rotation of a common eccentric shaft, wherein said support means supports said fixed and movable spirals so that the inner contact face of said first fixed spiral contact the outer contact face of said first movable spiral, to define a first working chamber between the inner and outer contact faces, the volume of the first working chamber decreasing while the first working chamber being shifted from the periphery toward the center of said spirals according to the oscillation of said first movable spiral inside said first fixed spiral, and so that the inner contact face of said second fixed spiral may be in contact with the outer contact face of said second movable spiral, to define a second working chamber between the inner and outer contact faces, the volume of the second working chamber decreasing while the second working chamber being shifted from the periphery toward the center of said spirals according to the oscillation of said second movable spiral inside said second fixed spiral.

* * * * *

UNITED STATES PATENT AND TRADEMARK OFFICE

CERTIFICATE OF CORRECTION

PATENT NO. : 5,788,470

DATED : August 4, 1998

INVENTOR(S) : Masayuki OKUDA, et al.

It is certified that error appears in the above-identified patent and that said Letters Patent is hereby corrected as shown below:

On the title page, insert the following:

-- item [30] Foreign Application Priority Data

November 1, 1995 [JP] Japan.....7-285316 --

Signed and Sealed this

Thirtieth Day of March, 1999

*Attest:*

*Attesting Officer*

Q. TODD DICKINSON

*Acting Commissioner of Patents and Trademarks*